US009298133B2

(12) United States Patent
Ito et al.

(10) Patent No.: US 9,298,133 B2
(45) Date of Patent: Mar. 29, 2016

(54) DEVELOPING DEVICE PROVIDED WITH SEAL CONFIGURED TO PREVENT DEVELOPER LEAKAGE

(71) Applicant: Brother Kogyo Kabushiki Kaisha, Nagoya-shi, Aichi-ken (JP)

(72) Inventors: Yoshinori Ito, Toyokawa (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/506,775

(22) Filed: Oct. 6, 2014

(65) Prior Publication Data

US 2015/0023687 A1 Jan. 22, 2015

Related U.S. Application Data

(63) Continuation of application No. 13/560,102, filed on Jul. 27, 2012, now Pat. No. 8,855,526.

(30) Foreign Application Priority Data

Jul. 29, 2011 (JP) ..... 2011-167284

(51) Int. Cl.
*G03G 15/08* (2006.01)

(52) U.S. Cl.
CPC ..... *G03G 15/0881* (2013.01); *G03G 15/0808* (2013.01); *G03G 15/0817* (2013.01); *G03G 15/0898* (2013.01)

(58) Field of Classification Search
CPC ..... G03G 15/0817; G03G 15/0881; G03G 15/0808; G03G 15/0898
USPC ..... 399/103, 102, 104, 105, 106
See application file for complete search history.

(56) References Cited

U.S. PATENT DOCUMENTS 5,502,547 A 3/1996 Shirai
6,321,050 B1 * 11/2001 Sato et al. ..... 399/103
(Continued)

FOREIGN PATENT DOCUMENTS

EP 1422577 A2 5/2004
EP 2 175 325 A2 4/2010
(Continued)

OTHER PUBLICATIONS

Extended European Search Report issued in corresponding European Patent Application No. 12178224.7 dated Apr. 11, 2013.
(Continued)

*Primary Examiner* — Billy Lactaoen
(74) *Attorney, Agent, or Firm* — Banner & Witcoff, Ltd.

(57) ABSTRACT

A developing device includes: a developing roller; a casing; and a seal. The developing roller has a rotational axis extending in an axial direction. The casing has a first wall, and a second wall extending from the first wall toward the developing roller in an extending direction. The seal is disposed on the first wall and in contact with a peripheral surface of the developing roller. The seal includes: a film contacting with the peripheral surface of the developing roller; and a substrate disposed between the film and the first wall. The second wall has a first surface facing in a first direction and a second surface facing in a second direction. The first surface extends in the extending direction and contacts with the substrate of the seal. The second surface faces away from the first surface.

11 Claims, 8 Drawing Sheets

(56) References Cited

U.S. PATENT DOCUMENTS

| | | | |
|---|---|---|---|
| 7,155,151 | B2 | 12/2006 | Okamoto |
| 8,301,056 | B2 | 10/2012 | Matsushita et al. |
| 2005/0185980 | A1 | 8/2005 | Okamoto |
| 2006/0072934 | A1 | 4/2006 | Fukuta |
| 2007/0059031 | A1 | 3/2007 | Mori et al. |
| 2010/0092206 | A1 | 4/2010 | Matsushita et al. |
| 2012/0269538 | A1 | 10/2012 | Matsushita et al. |
| 2012/0269539 | A1 | 10/2012 | Matsushita et al. |

FOREIGN PATENT DOCUMENTS

| | | | |
|---|---|---|---|
| JP | 08-220858 | | 8/1996 |
| JP | 11-265119 | | 9/1999 |
| JP | H11-316500 | A | 11/1999 |
| JP | 2001-134079 | A | 5/2001 |
| JP | 2007-188109 | A | 7/2007 |
| JP | 2010-164736 | A | 7/2010 |

OTHER PUBLICATIONS

Office Action issued in corresponding Chinese Patent Application No. 201210265099.9 mailed Dec. 4, 2013.

Second Office Action received in Chinese Application No. 201210265099.9 mailed on Jul. 24, 2014.

Office Action, issued in Apr. 16, 2013, in corresponding Japanese Patent Application No. 2011-167284.

Search Report issued in corresponding European Patent Application No. 12178224.7 mailed Dec. 5, 2012.

Dec. 24, 2014—(CN) Third Office Action—App 201210265099.9—English Translation.

* cited by examiner

DEVELOPING DEVICE PROVIDED WITH SEAL CONFIGURED TO PREVENT DEVELOPER LEAKAGE

CROSS REFERENCE TO RELATED APPLICATION

This application is a continuation of U.S. application Ser. No. 13/560,102, filed Jul. 27, 2012, which claims priority from Japanese Patent Application No. 2011-167284 filed Jul. 29, 2011. The entire contents of the above-noted applications are incorporated herein by reference.

TECHNICAL FIELD

The present invention relates to a developing device provided with a seal.

BACKGROUND

There is conventionally known a developing device including a casing having an opening portion, a developing roller provided so as to be opposed to the opening portion, and a lower film for preventing toner leakage from between a lower portion of the developing roller and the casing. More specifically, in this technique, the lower film is formed into an elongated shape extending in an axial direction of the developing roller, one end of the lower film positioned upstream side of a rotational direction of the developing roller being attached to the casing by a double-stick tape, the other end thereof being brought into sliding contact with the outer peripheral surface of the developing roller as a free end.

SUMMARY

However, in the above-described technique, the lower film is bent toward the developing roller to be pressed against the developing roller with an adequate pressing force. Therefore, the one end of the lower film may come off from the casing by a reaction force against the bending. Further, if the double-stick tape gets wrinkles when attached to the casing, toner may leak from a gap formed by the wrinkles. Therefore, the attachment work needs to be done in a careful manner, which makes the attachment work cumbersome and complicated.

In view of the foregoing, it is an object of the present invention to provide a developing device capable of preventing toner (developer) leakage with a simple mounting work while preventing a seal provided between the lower side of the developing roller and the casing from coming off.

In order to attain the above and other objects, the invention provides a developing device that may include: a developing roller; a casing; and a seal. The developing roller may have a rotational axis extending in an axial direction. The casing may have a first wall, and a second wall extending from the first wall toward the developing roller in an extending direction. The seal may be disposed on the first wall and in contact with a peripheral surface of the developing roller. The seal may include: a film contacting with the peripheral surface of the developing roller; and a substrate disposed between the film and the first wall. The second wall may have a first surface facing in a first direction and a second surface facing in a second direction. The first surface may extend in the extending direction and contact with the substrate of the seal. The second surface may face away from the first surface.

BRIEF DESCRIPTION OF THE DRAWINGS

The particular features and advantages of the invention as well as other objects will become apparent from the following description taken in connection with the accompanying drawings, in which.

DETAILED DESCRIPTION

An embodiment of the present invention will be described in detail below with reference to the accompanying drawings.

In the following description, the entire configuration of a laser printer will be described briefly first, followed by characteristic portions of the present invention.

Further, in the following description, directions are defined as viewed from a user who operates a printer 1. That is, right side in FIG. 1 is defined as "front side," left side therein as "rear side," far side therein as "right side," and near side therein as "left side." Further, vertical direction in FIG. 1 is defined as "up-and-down direction."

Figure 1:
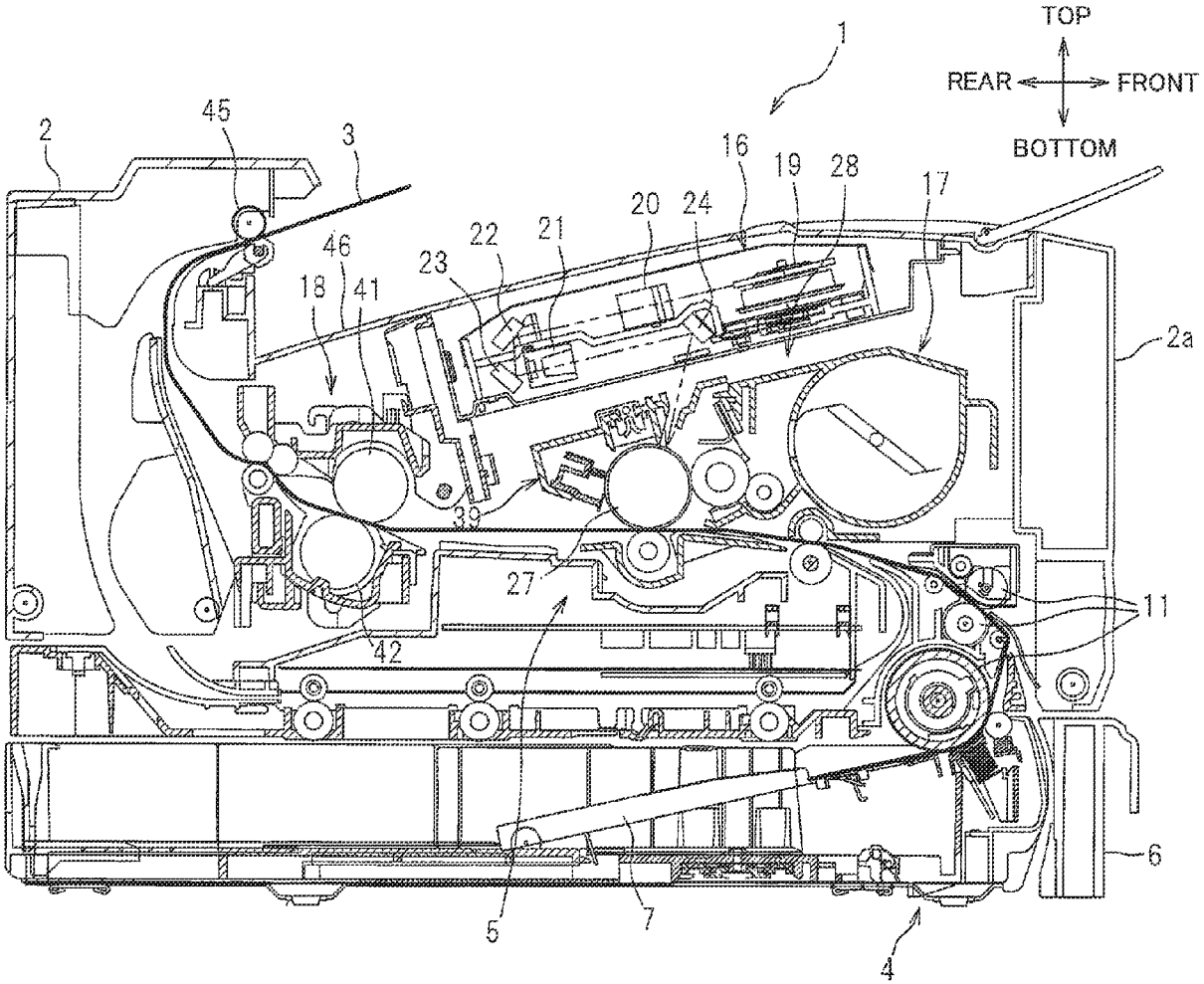
FIG. 1 is a cross-sectional view of a laser printer provided with a developing cartridge according to an embodiment of the present invention.

As illustrated in FIG. 1, the laser printer 1 includes, in a main body casing 2, a feeder section 4 for feeding a paper sheet 3, and an image forming section 5 for forming an image on the paper sheet 3.

The feeder section 4 includes a paper supply tray 6 detachably mounted to a bottom portion of the main body casing 2 and a paper pressing plate 7 provided in the paper supply tray 6. The feeder section 4 further includes various rollers 11 for feeding the paper sheet 3 and removing paper powder. In this feeder section 4, a plurality of paper sheets 3 in the paper supply tray 6 are pressed upward by the paper pressing plate 7 and then fed one by one by the various rollers 11 to the image forming section 5.

The image forming section 5 includes a scanner unit 16, a process cartridge 17, and a fixing section 18.

The scanner unit 16 is provided in an upper portion of the main body casing 2 and includes a laser emitting section (not illustrated), a rotation-driven polygon mirror 19, lenses 20 and 21, reflecting mirrors 22, 23, and 24. In the scanner unit 16, a laser beam passes through a path denoted by a long dashed double-dotted line in the drawing and is irradiated in a high-speed scanning operation onto a surface of a photosensitive drum 27.

The process cartridge 17 is detachably attached to the main body casing 2 from the front side of the main body casing 2 by opening a front cover 2*a*. The process cartridge 17 includes mainly a developing cartridge 28 (one example of the developing device) and a drum unit 39.

Figure 2:
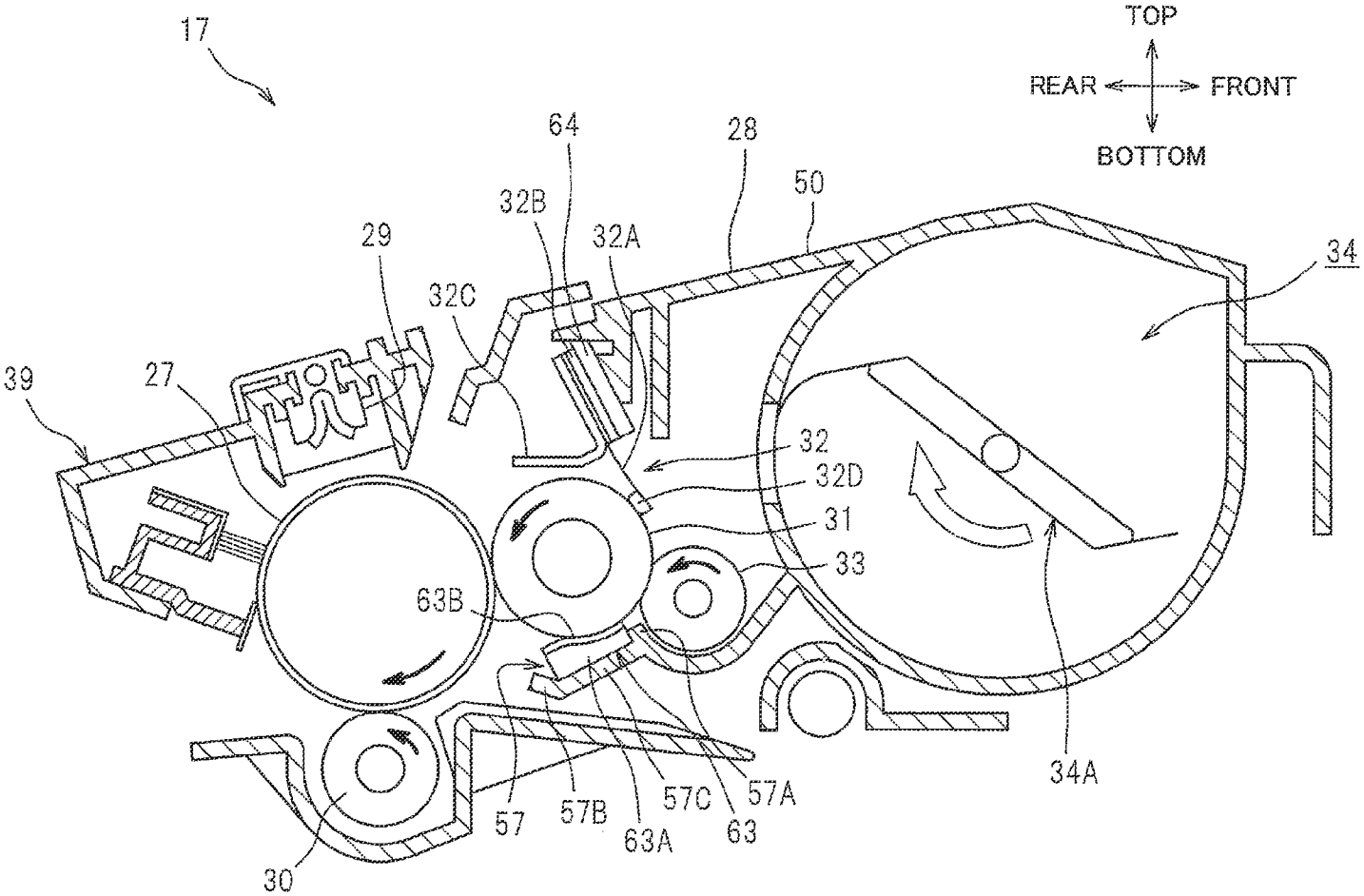
FIG. 2 is a cross-sectional view of the developing cartridge.

The developing cartridge 28 is detachably attached to the main body casing 2 in a state where the developing cartridge 28 is attached to the drum unit 39. As illustrated in FIG. 2, the developing cartridge 28 includes a developing roller 31, a layer-thickness regulating blade 32, a supply roller 33, and a toner containing chamber 34.

In the developing cartridge 28, toner (one example of the developer) contained in the toner containing chamber 34 is agitated by an agitator 34A and is supplied to the developing roller 31 by the supply roller 33. At this time, the toner is charged by friction between the supply roller 33 and developing roller 31. Then, with the rotation of the developing roller 31, the toner carried on the outer peripheral surface of the developing roller 31 enters between the layer-thickness regulating blade 32 and developing roller 31 and is then carried on the developing roller 31 as a thin layer of a predetermined thickness while being charged by friction.

The drum unit 39 includes the photosensitive drum 27, a scorotron charger 29, and a transfer roller 30. In the drum unit 39, the surface of the photosensitive drum 27 is uniformly positively charged by the scorotron charger 29 and is thereafter exposed by the high-speed scanning operation of the laser beam from the scanner unit 16. As a result, electric potential at the exposed portion decreases and thus an electrostatic latent image based on image data is formed.

Subsequently, the toner carried on the developing roller 31 is supplied, by rotation of the developing roller 31, to the electrostatic latent image formed on the surface of the photosensitive drum 27, whereby a toner image is formed on the surface of the photosensitive drum 27. Thereafter, the paper sheet 3 is fed between the photosensitive drum 27 and transfer roller 30, whereby the toner image carried on the surface of the photosensitive drum 27 is transferred onto the paper sheet 3.

As illustrated in FIG. 1, the fixing section 18 includes a heating roller 41 and a pressure roller 42 disposed opposite to the heating roller 41 so as to pressurize the heating roller 41. In the fixing section 18 having the above configuration, the toner transferred onto the paper sheet 3 is thermally fixed during the passage of the paper sheet 3 between the heating roller 41 and the pressure roller 42. The paper sheet 3 onto which the toner has been thermally fixed in the fixing section 18 is fed to a paper discharge tray 46 by a paper discharge roller 45 disposed on the downstream side of the fixing section 18.

<Detailed Configuration of Developing Cartridge>

Figure 3:
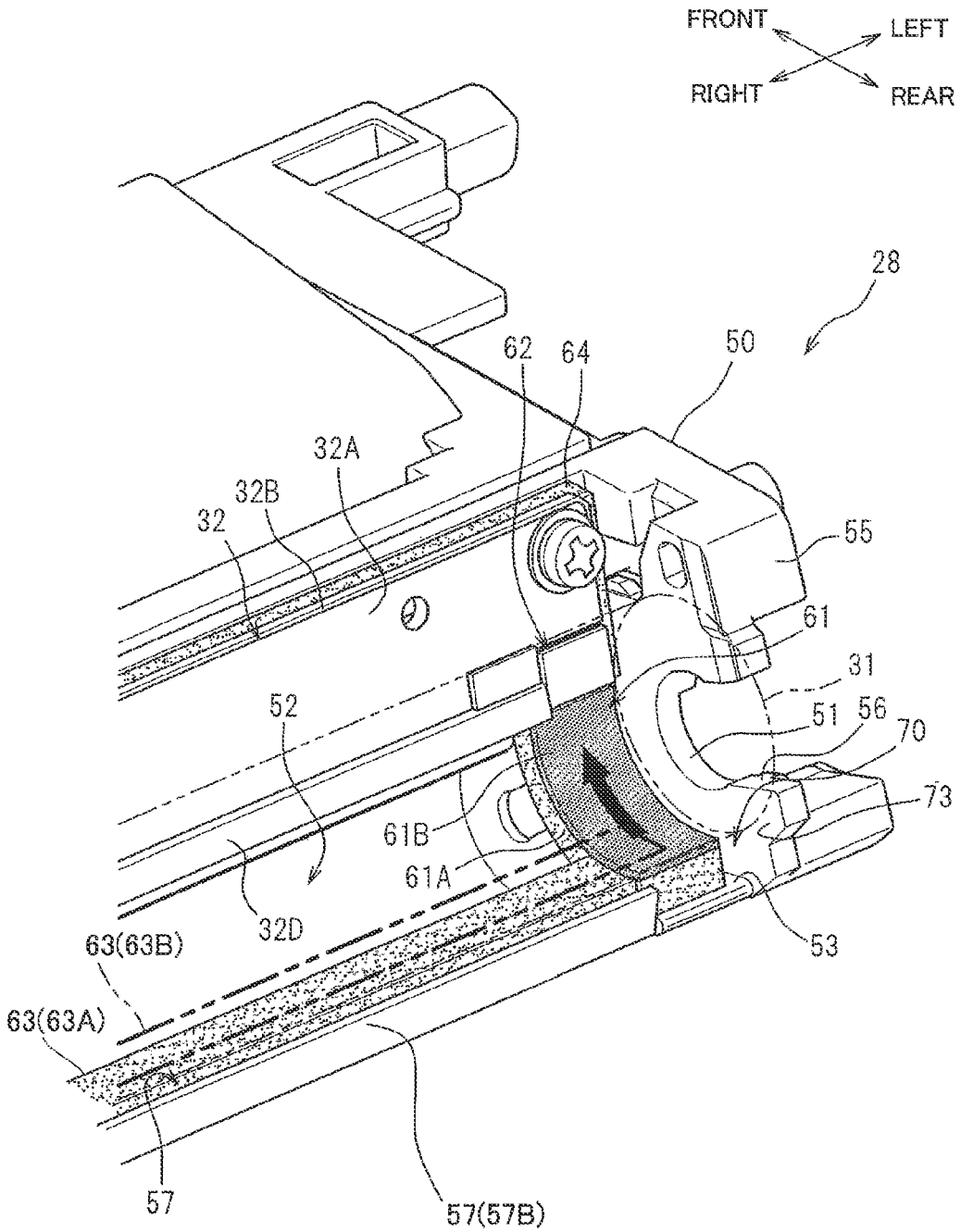
FIG. 3 is an enlarged perspective view of the developing cartridge near an opening portion.

Next, a configuration of the developing cartridge 28 according to the embodiment of the present invention will be described in detail. FIG. 3 illustrates a state where the developing roller 31 and supply roller 33 have been removed from a casing 50.

As illustrated in FIG. 3, the developing cartridge 28 includes, in addition to the above-described developing roller 31, the casing 50 that rotatably supports the developing roller 31, a pair of side seal members 61, a pair of blade seal members 62, and a lower seal 63 (one example of the seal member). The pair of side seal members 61 is brought into sliding contact with both axial direction end portions of the developing roller 31, respectively. Further, the pair of blade seal members 62 is also brought into sliding contact with both axial direction end portions of the developing roller 31, respectively. The developing roller 31 rotates in a rotational direction shown by an arrow in the drawing, that is, rotates in the direction from the side seal member 61 toward the blade seal member 62.

In the casing 50, there are formed a support portion 51 that rotatably supports the developing roller 31, an opening portion 52 for supplying the toner from the toner containing chamber 34 inside the casing 50 to the developing roller 31, a side seal attachment surface 53 to which the side seal member 61 is attached, and an attachment groove 57 in which the lower seal 63 goes.

The support portion 51 is formed as a circular hole penetrating, in a left-right direction, a side wall 55 protruding rearward from a left-right direction outside end portion of the side seal attachment surface 53 so as to support both end portions of a rotary shaft of the developing roller 31 directly or through a bearing. A guide groove 56 protruding rearward and opened rearward is formed on the rear side of the support portion 51 so as to communicate with the support portion 51.

Thus, as described later, when the rotary shaft of the developing roller 31 is inserted into the developing cartridge 28 along the guide groove 56 from outside the casing 50, the rotary shaft of the developing roller 31 is guided from outside the casing 50 to the support portion 51. The developing roller 31 supported in the support portion 51 is disposed at a position opposite to the opening portion 52 and can receive supply of the toner through the opening portion 52.

The opening portion 52 is formed into a rectangular hole elongated along the axial direction of the developing roller 31, and the layer-thickness regulating blade 32 is fixed to the upper portion of the opening portion 52.

As illustrated in FIG. 2, the layer-thickness regulating blade 32 includes a metal plate 32A, reinforcing plates 32B and 32C that sandwich an upper portion of the metal plate 32A for reinforcing purpose, and a pressing member 32D made of rubber which is fixed to a lower portion (leading end portion) of the metal plate 32A and which is smaller in left-right direction width than the metal plate 32A. The layer-thickness regulating blade 32 is fixed to the casing 50 at the upper portion of the metal plate 32A sandwiched by the reinforcing plates 32B and 32C. The pressing member 32D at the leading end of the layer-thickness regulating blade 32 is brought into sliding contact with the developing roller 31 by a biasing force of the metal plate 32A. In FIG. 3, the outside reinforcing plate 32C has been removed from the metal plate 32A.

Figure 4:
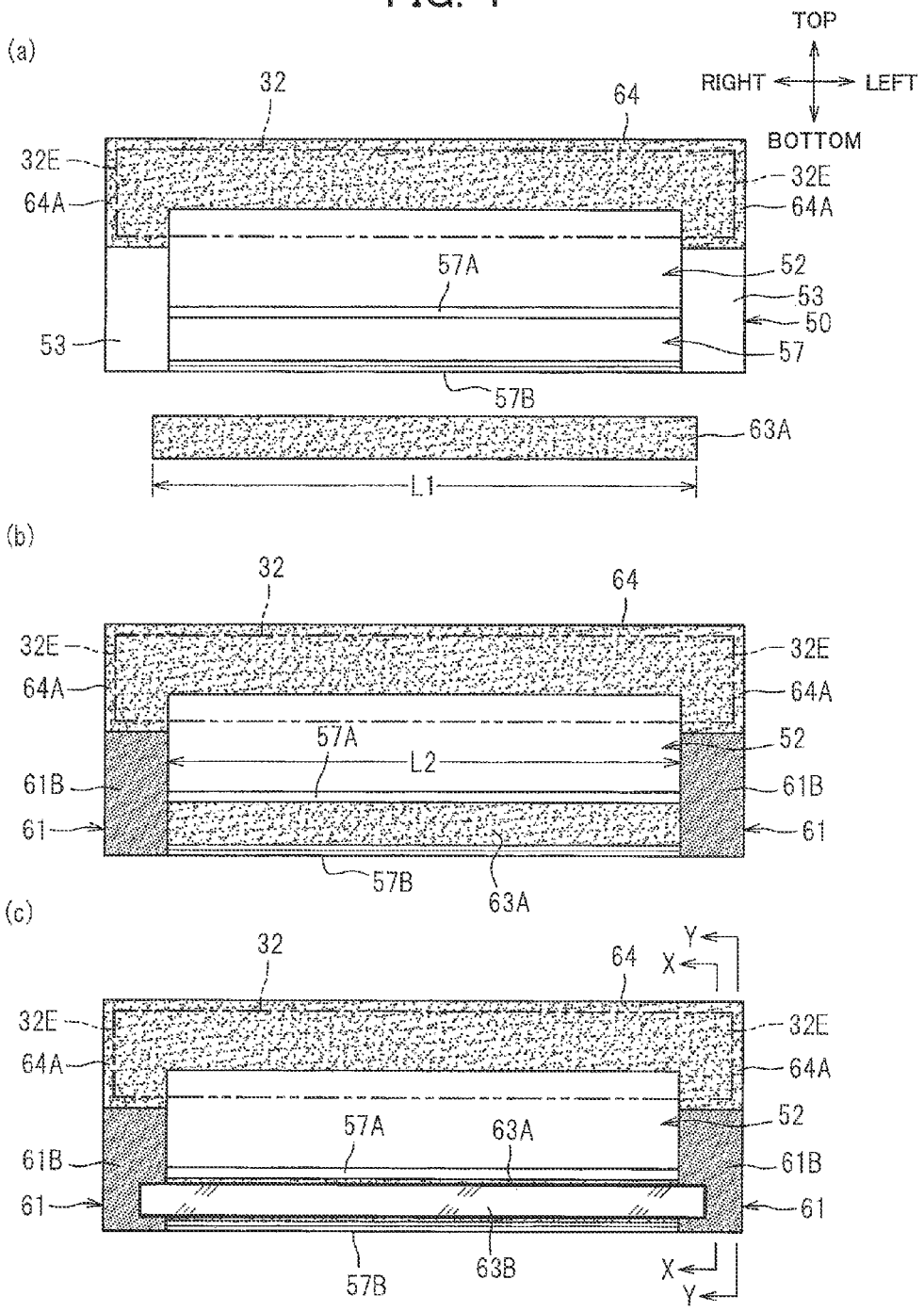
FIG. 4 is an explanation view of attachment of a lower seal to the developing cartridge.

A blade back seal 64 is provided between the layer-thickness regulating blade 32 and casing 50. More specifically, as schematically illustrated in FIG. 4(*a*), the blade back seal 64 is formed into a reverse U-like shape surrounding an upper side portion of the opening portion 52 and attached, at both ends thereof, to an upper portion of the side seal attachment surface 53.

Figure 5:
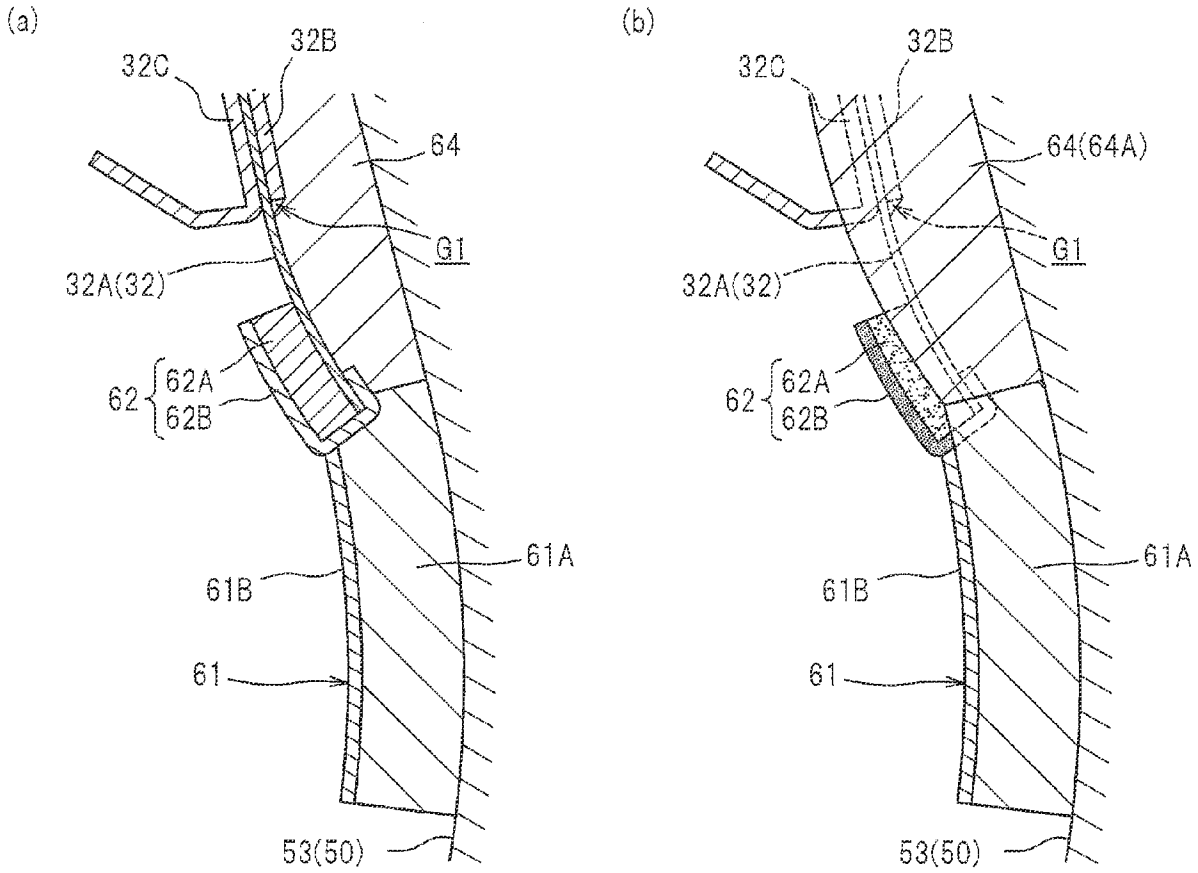
FIG. 5 is a cross-sectional view of FIG. 4.

The blade back seal 64 is formed longer than the layer-thickness regulating blade 32 in the left-right direction (longitudinal direction), and both end portions 64A of the blade back seal 64 in the left-right direction protrude from both end portions 32E of the layer-thickness regulating blade 32 in the left-right direction, respectively. As a result, when the layer-thickness regulating blade 32 is fixed to the casing 50 so as to compress the blade back seal 64, the both end portions 32E of the layer-thickness regulating blade 32 are covered by the end portions 64A of the blade back seal 64 that are not compressed. Thus, as shown in FIG. 5 in which (a) is an X-X cross sectional view of FIGS. 4(*c*) and (*b*) is a Y-Y cross sectional view of FIG. 4(*c*), a minor gap G1 formed between the compressed blade back seal 64 and a level difference (level difference between the metal plate 32A and inner reinforcing plate 32B) of the layer-thickness regulating blade 32 is filled with the both end portions 64A of the blade back seal 64 (in FIG. 5(*b*), a lower end of the layer-thickness regulating blade 32 is covered by a lower end portion of the blade back seal 64), thereby preventing toner leakage.

As illustrated in FIG. 3, the side seal attachment surface 53, which is an arc-like surface, is formed on both the left and right sides (axial direction both sides of the developing roller 31) of the opening portion 52.

As illustrated in FIG. 2, the attachment groove 57 is formed on a lower side of the opening portion 52 (see FIG. 3) of the casing 50 and includes mainly a restricting wall 57A, an inclined wall 57B disposed at the upstream of the restricting wall 57A, and a bottom wall 57C connecting the restricting wall 57A to the inclined wall 57B.

The restricting wall 57A is formed substantially perpendicular to the bottom wall 57C, which brings the restricting wall 57A into close surface contact with the front surface of the rectangular solid lower seal 63 when the lower seal 63 is placed on the bottom wall 57C.

The inclined wall 57B is inclined relative to the bottom wall 57C so as to be away from the restricting wall 57A toward the developing roller 31 side. Thus, the lower seal 63 is guided to the restricting wall 57A along the inclined wall 57B so that the front surface of the lower seal 63 is brought into close surface contact with the restricting wall 57A.

As illustrated in FIG. 3, each of the side seal members 61 is provided between each of the both end portions of the developing roller 31 and the side seal attachment surface 53 of the casing 50.

The side seal member 61 includes a substrate 61A having elasticity and a sliding contact member 61B provided on the substrate 61A so as to be brought into slide contact with the developing roller 31. The substrate 61A is formed of elastically-deformable urethane sponge which is softer than a material of the slide contact member 61B and is fitted in a concave portion and a plurality of ribs formed in the side seal attachment surface 53 of the casing 50. The substrate 61A may be attached to the side seal attachment surface 53 of the casing 50 by a double-stick tape or an adhesive.

The sliding contact member 61B is formed of a felt material thinner than the substrate 61A and is attached to the substrate 61A by a double-stick tape. The front, rear, left, and right surfaces of the sliding contact member 61B are flush with those of the substrate 61A.

The blade seal members 62 are provided at both end portions of the layer-thickness regulating blade 32 in the left-right direction, respectively, so as to tightly contact left and right both end edges of the layer-thickness regulating blade 32 and each positioned adjacent to the side seal member 61 in the rotational direction of the developing roller 31. As illustrated in FIG. 5(*a*), the blade seal member 62 is formed by attaching, by a double-stick tape, a substrate 62A and a sliding contact member 62B thinner than the substrate 62A, likewise the above-described side seal member 61. The substrate 62A is attached by a double-stick tape to the metal plate 32A of the layer-thickness regulating blade 32, whereby the blade seal member 62 is fixed to the layer-thickness regulating blade 32.

The sliding contact member 62B is formed longer than the substrate 62A in the rotational direction of the developing roller 31, and is bent at the leading end of the layer-thickness regulating blade 32 (metal plate 32A) so as to wrap the layer-thickness regulating blade 32 from the lower side. This prevents the blade seal member 62 from coming off due to rotation of the developing roller 31.

Further, the configuration in which only the thin sliding contact member 62B is bent to attach the blade seal member 62 to the layer-thickness regulating blade 32 (metal plate 32A) can significantly reduce a level difference which is formed by the metal plate 32A and the sliding contact member 62B. Thus, the blade back seal 64 compressed toward the metal plate 32A and the sliding contact member 62B can be deformed so as to follow the reduced level difference, thereby preventing toner leakage from around the level difference.

As shown in FIG. 5(*a*), the bent portion of the sliding contact member 62B contacts an upper end portion of its adjacent side seal member 61 (upper ends of the substrate 61A and sliding contact member 61B). This prevents toner leakage from between the side seal member 61 and blade seal member 62.

As illustrated in FIG. 3, the lower seal 63 is a member that prevents the toner from leaking from between the outer peripheral surface of the developing roller 31 and casing 50 and includes a substrate 63A formed of urethane sponge (one example of the elastic member) and a film member 63B provided on the substrate 63A so as to contact the outer peripheral surface of the developing roller 31. As illustrated in FIG. 2, the lower seal 63 is held by being sandwiched between the developing roller 31 and casing 50 in a state of being merely placed in the attachment groove 57 without using an adhesive.

More specifically, the lower seal 63 is placed in the attachment groove 57, and then the developing roller 31 is mounted in the casing 50, whereby the lower seal 63 is held by being sandwiched between the developing roller 31 and casing 50 in a state of being adjacent to the restricting wall 57A. Upon rotation of the developing roller 31, a force directed in the rotation (downstream) direction is applied from the developing roller 31 to the lower seal 63 to press the lower seal in the downstream direction; however, the downstream direction movement of the lower seal 63 is restricted by the restricting wall 57A.

As a result, the lower seal 63 is pressed against the restricting wall 57A to tightly contact the restricting wall 57A, thereby preventing the lower seal 63 from coming off from the casing 50.

Further, since the lower seal 63 can be attached to the casing 50 simply by placing the lower seal 63 in the attachment groove 57 and sandwiching the same between the developing roller 31 and casing 50, the attachment work of the lower seal 63 can be made simpler than that in a configuration in which the seal member is fixed to the casing by, e.g., a double-stick tape. The absence of the double-stick tape between the lower seal 63 and the casing 50 can prevent a gap from being formed at the attachment work of the lower seal 63 due to formation of wrinkles in the double-stick tape, thereby preventing toner leakage without fail. Note that such wrinkles are likely to occur particularly when an elongated lower seal is used.

In a state where the lower seal 63 abuts against the restricting wall 57A, the developing roller 31 contacts a portion of the lower seal 63 that is positioned downstream in the rotational direction relative to the center (center of the developing roller 31 in the rotational direction) thereof. Thus, the developing roller 31 can be separated more away from the leading end (upstream side end portion in the rotational direction) of the film member 63B than in a configuration in which the developing roller is made to contact the center of the lower seal, thereby preventing the leading end of the film member 63B raised due to deformation of the substrate 63A from being brought into sliding contact with the outer periphery of the developing roller 31.

As illustrated in FIG. 3, the substrate 63A of the lower seal 63 is formed into a rectangular solid extending in the left-right direction and is provided between the film member 63B and casing 50 so as to press the film member 63B against the developing roller 31. A length L1 of the substrate 63A before attachment to the casing 50 is longer than a distance L2 between the pair of side seal members 61 attached to the casing 50.

When the substrate 63A and the side seal members 61 are attached to the casing 50, the substrate 63A is first placed on the attachment groove 57 with the both end portions thereof protruding from the left and right both ends of the attachment groove 57 of the casing 50, as illustrated in FIG. 4(*a*). Thereafter, while contracting the substrate 63A in the left-right direction with the surface of the substrate 63A held using a jig, the side seal members 61 are attached to the side seal attachment surfaces 53 on both the left and right sides of the substrate 63A.

As a result, both the left and right end surfaces of the substrate 63A are brought into press contact with the left-right direction inner surfaces of the respective side seal members 61, thereby preventing toner leakage from between the substrate 63A and side seal members 61.

As illustrated in FIG. 4(*c*), the film member 63B is a sheet-like member formed of polyethylene terephthalate and extends in the axial direction of the developing roller 31 so as to be brought into sliding contact with the developing roller 31 over substantially the entire axial length thereof. More specifically, the both end portions of the film member 63B protrude outward in the left-right direction (toward the side seal member 61 side) from the substrate 63A, and the protruding both end portions thereof are put on (overlap) the respective side seal members 61.

In the conventional configuration, the film member is provided between the both side seal members. Therefore, the film member may hit the inner surface of the side seal member at the attachment time of the lower seal or side seal member, thereby bending the film member. As a result, toner may leak from between the film member and the developing roller.

However, the protruding end portions of the film member 63B are put on (overlap) the respective side seal members 61 in the present embodiment. Therefore, toner leakage from between the film member 63B and developing roller 31 can be prevented since the film member 63B is not bent.

Figure 6:
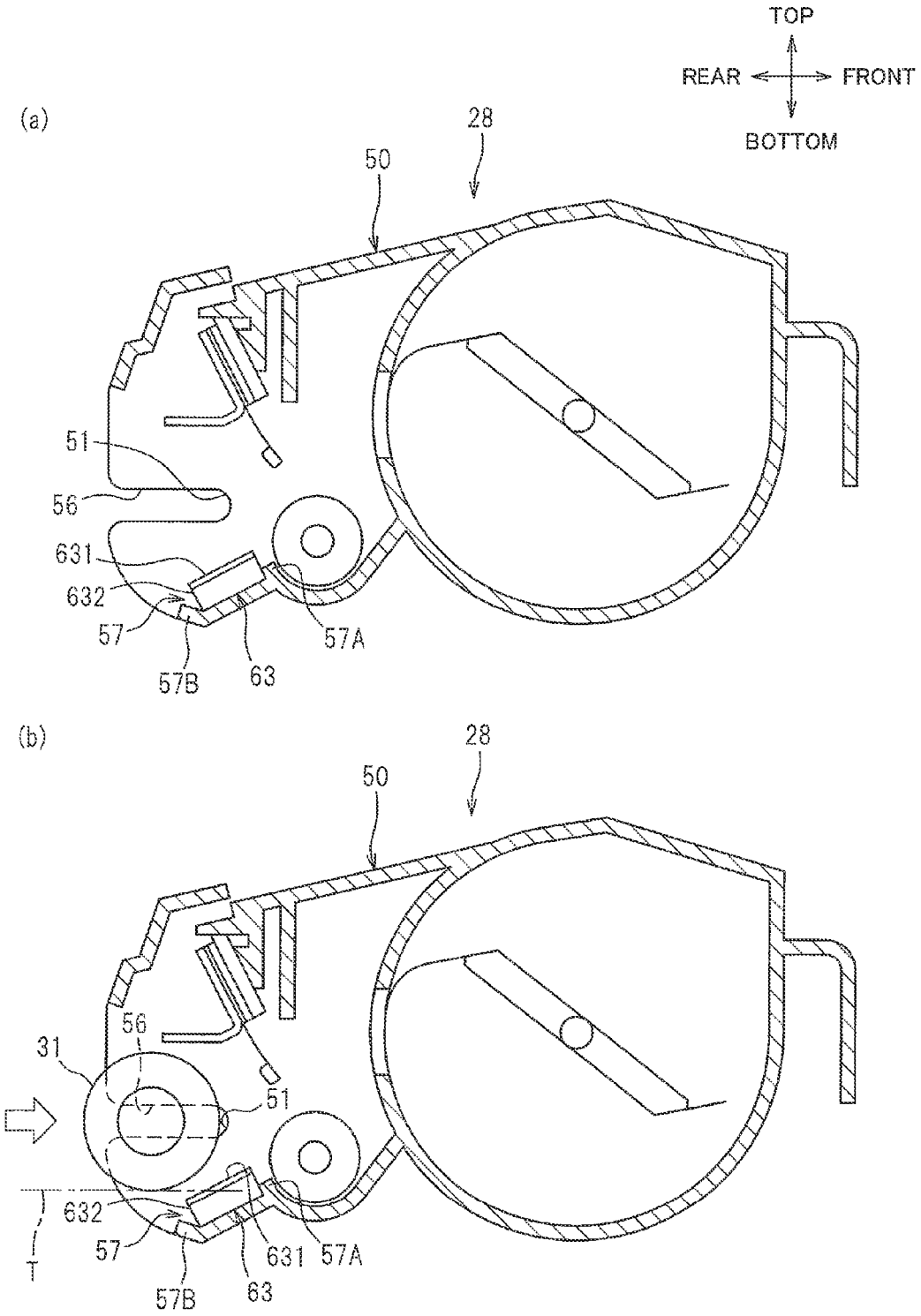
FIG. 6 is an explanation view of insertion of a developing roller into a guide groove.

As illustrated in FIG. 6, the above-described guide groove 56 of the casing 50 is formed at a position and angle such that the developing roller 31 abuts against an upper surface 631 (developing roller 31 side surface) of the lower seal 63 when the developing roller 31 is mounted to the support portion 51. In other words, the guide groove 56 is formed at a position and angle such that a trajectory T of the developing roller 31 upon mounting of the developing roller 31 to the support portion 51 intersects the upper surface 631 of the lower seal 63.

This configuration prevents the developing roller 31 from abutting against an upper rear side corner of the lower seal 63 upon mounting of the developing roller 31 to the support portion 51, thereby preventing the lower seal 63 from swaying and coming off from the attachment groove 57.

While the invention has been described in detail with reference to the embodiment thereof, it would be apparent to those skilled in the art that various changes and modifications may be made therein without departing from the spirit of the invention.

Figure 7:
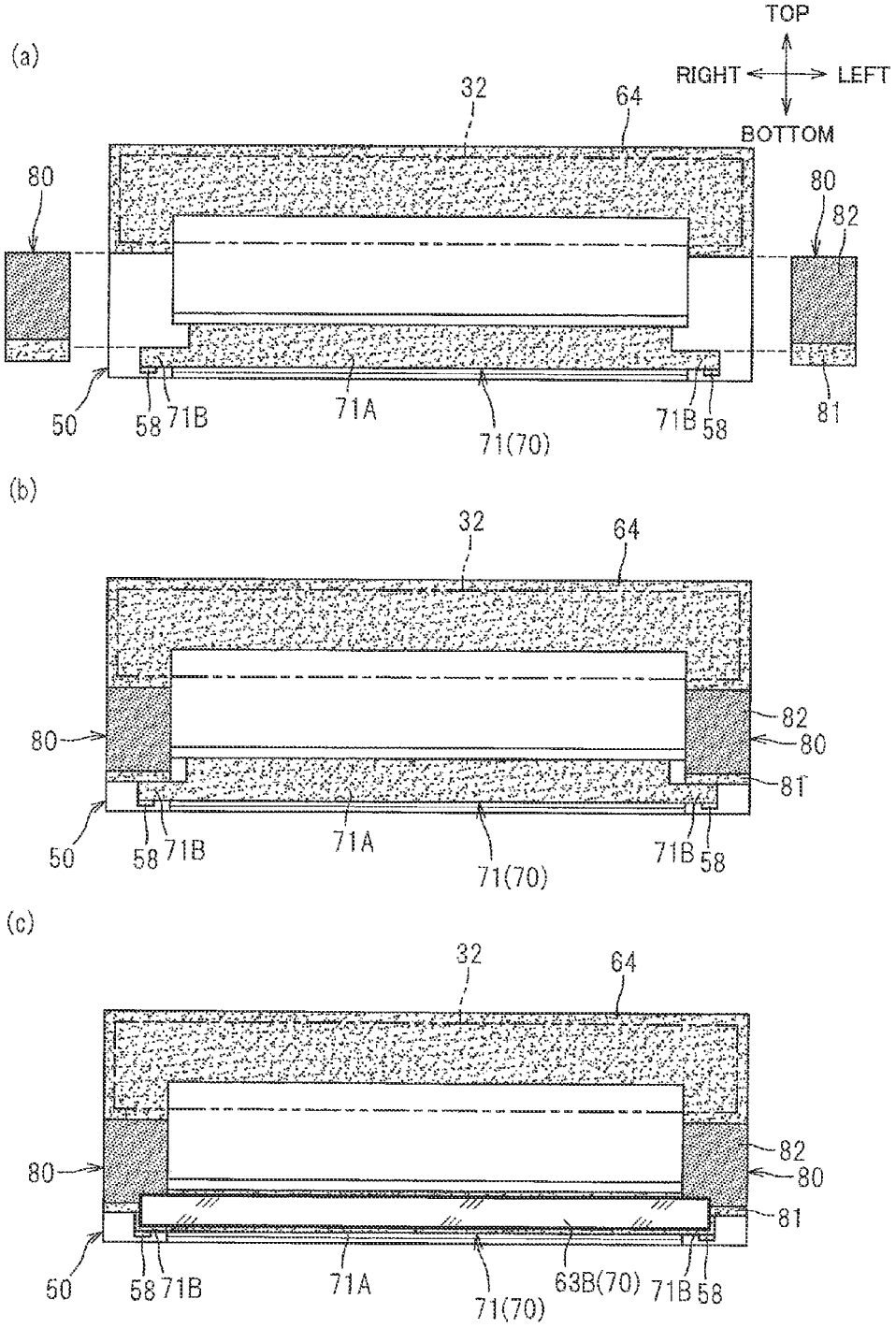
FIG. 7 is an explanation view of attachment of a lower seal to the developing cartridge according to a variation.

For example, although the lower seal 63 (substrate 63A) is attached to the casing 50 by press contact with the inner surfaces of the respective side seal members 61 in the above embodiment, a configuration shown in FIG. 7 may be employed. In FIG. 7, the same reference numerals are used for components substantially the same as those in the first embodiment, and the descriptions thereof are omitted.

As illustrated in FIG. 7, a lower seal 70 includes a substrate 71 formed of the same material as the lower seal 63 in the above embodiment but having a shape different therefrom and a film member 63B substantially the same as that in the above embodiment. The substrate 71 includes a main body 71A having a length shorter than a distance between a pair of side seal members 80 that have been attached to the casing 50 and a pair of protruding portions 71B extending outward in the left-right direction respectively from both left and right end portions of the main body 71A.

As illustrated in FIG. 7(*b*), in the casing 50, a pair of ribs 58 is disposed upstream of the pair of side seal members 80 in the rotational direction, respectively, so as to be spaced apart from the pair of side seal members 80. Each protruding portion 71B is sandwiched between the corresponding rib 58 and side seal member 80, thereby bringing the protruding portion 71B into press contact with the side seal member 80.

More specifically, as illustrated in FIG. 7(*a*), a substrate 81 of the side seal member 80 before attachment to the casing 50 protrudes downward from a lower end of a sliding contact member 82 of the side seal member 80 in the rotational direction. Further, the substrate 81 before attachment to the casing 50 is longer than a length between the protruding portion 71B and blade back seal 64 in the rotational direction.

Since the lower side end portion of the substrate 81 is not restrained by the sliding contact member 82, the crush amount of the lower side end portion of the substrate 81 can be increased. Therefore, as shown in FIG. 7(*b*), when the side seal member 80 is attached to the casing 50, the substrate 81 is contracted and brought into press contact with the protruding portion 71B, thereby bringing the end portion into tight contact with the protruding portion 71B.

Figure 8:
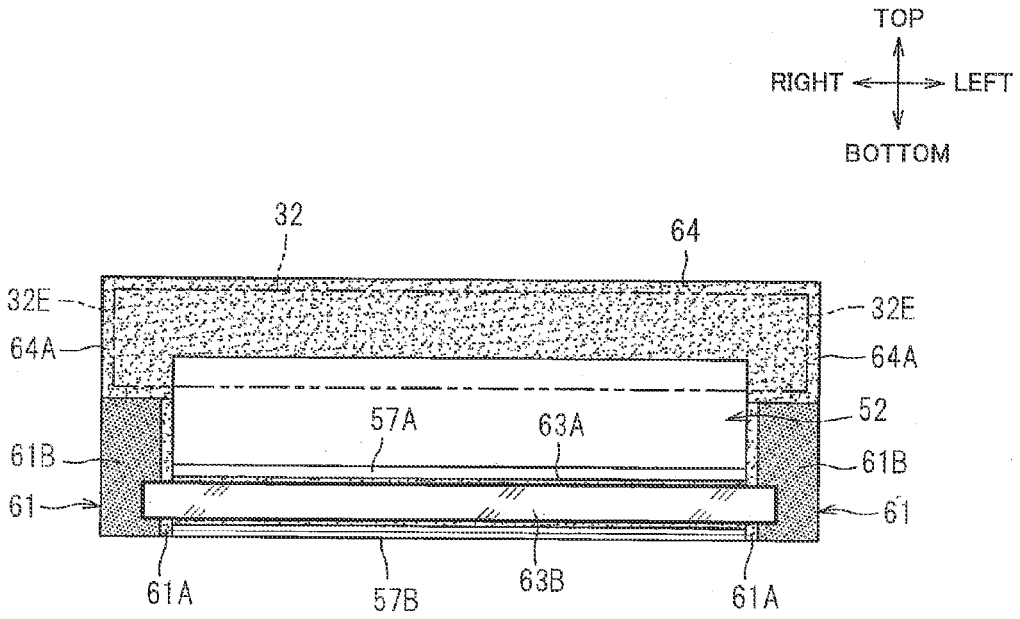
FIG. 8 is an explanation view of a side seal member according to a variation.

Further, although, as shown in FIG. 4, the inner surface of the sliding contact member 61B in the left-right direction is flush with that of the substrate 61A in the above embodiment, the inner surface of the sliding contact member 61B in the left-right direction may be positioned outward of that of the substrate 61A, as shown in FIG. 8.

This construction suppresses restriction of deformation of the left-right direction inner portion of the substrate 61A by the sliding contact member 61B. Therefore, when the base material 63A of the lower seal 63 and substrate 61A of the side seal member 61 are brought into press contact with each other, the crush amount of the substrate 61A is increased, thereby increasing contact between the lower seal 63 and side seal member 61.

Note that, in FIG. 8, the film member 63B is formed so as to protrude toward the side seal member 61 side from the substrate 63A, and the protruding portions thereof are put on (overlap) the sliding contact members 61B of the side seal member 61.

Further, although the sliding contact member 62B of the blade seal member 62 is formed thinner than the substrate 62A in the above embodiment, the sliding contact member may be formed thicker than the substrate.

Further, although the urethane sponge has been taken as an example of an elastic member in the above embodiment, other sponge materials may be employed. Further, other resin materials may be employed as a material of the film member instead of the polyethylene terephthalate mentioned in the above embodiment. Further, materials of the substrate and sliding contact member which constitute the side seal member are not limited to those mentioned in the above embodiment, but may be changed according to need.

Further, although the lower seal 63 is put into the attachment groove 57 in the above embodiment, a configuration may be adopted in which only the restricting wall 57A is formed in the casing 50, and the lower seal 63 is sandwiched between the developing roller 31 and casing 50 in a state of being adjacent to the restricting wall 57A.

Although the present invention has been applied to the developing cartridge 28 in the above embodiment, the present invention is not limited to this. For example, the present invention may be applied to other developing device such as a process cartridge obtained by combining the developing cartridge and drum unit or a developing unit receiving supply of toner from a toner cartridge for containing the toner.

What is claimed is:

1. A developing device comprising:

a developing roller having a rotational axis extending in an axial direction;

a casing having a groove, the groove being defined by a first wall, a second wall, and a third wall, the second wall extending from the first wall toward the developing roller in an extending direction; and a seal disposed in the groove at a position on the first wall and in contact with a peripheral surface of the developing roller, the seal including:

a film contacting with the peripheral surface of the developing roller; and a substrate disposed between the film and the first wall, wherein a contact surface of the first wall of the casing contacts the substrate, the contact surface having a first end and a second end in a direction perpendicular to the axial direction of the developing roller, wherein the second wall has a first surface extending from the first end of the contact surface of the first wall and forms an angle with the contact surface of less than 180°, wherein a surface of the third wall extends from the second end of the contact surface of the first wall and forms an angle with the contact surface of less than 180°, wherein the second wall at least partially overlaps the seal when viewed in a first direction parallel to the contact surface of the first wall and perpendicular to the axial direction of the developing roller, and the third wall at least partially overlaps the seal when viewed in a second direction parallel to the contact surface of the first wall and perpendicular to the axial direction of the developing roller, and wherein the first surface of the second wall faces in a third direction, the second wall having a second surface facing in a fourth direction, the first surface extending in the extending direction and contacting with the substrate of the seal, the second surface facing away from the first surface.

2. The developing device according to claim 1, wherein the fourth direction is opposite to the third direction.

3. The developing device according to claim 1, further comprising a supply roller configured to supply toner to the developing roller, wherein the second surface faces the supply roller.

4. The developing device according to claim 1, wherein a length of the seal in a direction from the first wall toward the developing roller is greater than a length of the first surface in a direction from the first wall toward the developing roller.

5. The developing device according to claim 1, wherein a length of the substrate in a direction from the first wall toward the developing roller is greater than a length of the first surface in a direction from the first wall toward the developing roller.

6. The developing device according to claim 1, wherein the third wall is inclined relative to the first wall so as to be away from the second wall.

7. The developing device according to claim 1, wherein the developing roller contacts the seal at a downstream portion of a center of the seal in a perpendicular direction perpendicular to both the extending direction and the axial direction when viewed in the axial direction of the developing roller.

8. The developing device according to claim 1, wherein the casing further includes:

a support portion configured to support both ends of the developing roller in the axial direction; and a guide groove configured to guide both of the ends of the developing roller from outside the casing to the support portion.

9. The developing device according to claim 8, wherein, when viewed from the axial direction, a direction in which the guide groove extends crosses a direction in which the film extends.

10. The developing device according to claim 1, wherein the casing has a third surface connecting the first surface and the second surface.

11. The developing device according to claim 1, wherein the extending direction is perpendicular to a direction in which the first wall extends.

* * * * *